US006195516B1

(12) United States Patent
Ikeda et al.

(10) Patent No.: US 6,195,516 B1
(45) Date of Patent: Feb. 27, 2001

(54) DEVELOPING DEVICE

(75) Inventors: Wataru Ikeda, Kawasaki; Kenji Tanaka, Tokyo, both of (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/506,615

(22) Filed: Feb. 18, 2000

(51) Int. Cl.[7] ..... G03G 15/08
(52) U.S. Cl. ..... 399/103; 399/254; 399/258
(58) Field of Search ..... 399/258, 103, 399/256, 254, 255, 262, 102, 105, 106; 222/DIG. 1; 366/241, 279

(56) References Cited

U.S. PATENT DOCUMENTS 4,998,140 * 3/1991 Satou et al. ..... 399/105
5,005,517 * 4/1991 Fukui et al. ..... 399/258 X
5,475,478 * 12/1995 Nishimura et al. ..... 399/262 X
5,491,537 * 2/1996 Suzuki et al. ..... 399/262
5,835,828 * 11/1998 Jyoroku ..... 399/256

FOREIGN PATENT DOCUMENTS 60-47587 10/1985 (JP) .
11-288160 * 10/1999 (JP) .

* cited by examiner

*Primary Examiner*—Sophia S. Chen
(74) *Attorney, Agent, or Firm*—Foley & Lardner

(57) ABSTRACT

A developing device includes a receiving section for receiving a developer, a transferring chamber for transferring toner supplied from a toner cartridge, an auger formed to extend in the transferring chamber and rotated to transfer toner in the transferring chamber into the receiving section, and a developing roller for supplying toner in the receiving section to an electrostatic latent image on a photosensitive drum. An opening portion for permitting toner to be transferred is formed between the receiving section and the transferring chamber which accommodates the auger. An initial developer used when an image forming apparatus is started to be used is received in the transferring chamber and the opening portion between the transferring chamber and the receiving section is sealed. When the apparatus is started to be used, a seal member tightly closing the opening portion is removed and the initial developer in the transferring chamber is transferred into the receiving section via the opening portion by rotating the auger.

12 Claims, 3 Drawing Sheets

DEVELOPING DEVICE

BACKGROUND OF THE INVENTION

This invention relates to a developing device mounted on an image forming apparatus such as a copying machine or printer.

An image forming apparatus such as a copying machine or printer has a developing device for supplying a developer to an electrostatic latent image formed on the surface of a photosensitive drum to develop the same.

The developing device includes a receiving section for receiving a developer containing toner and carrier and a developing roller for supplying the developer received in the receiving section to an electrostatic latent image formed on the surface of a photosensitive drum.

The toner contained in the developer in the receiving section is stirred together with the carrier and charged. The charged toner is held on the developing roller via the carrier and then supplied to the electrostatic latent image formed on the surface of the photosensitive drum by rotation of the developing roller. The toner supplied from the developing roller is transferred onto the electrostatic latent image by electrostatic force to visualize the electrostatic latent image.

At the time of shipment of the above type of image forming apparatus, it is necessary to insert an initial developer having toner and carrier mixed in a proper ratio into the receiving section of the developing device after the apparatus is set in a preset position. As a method for inserting the initial developer into the receiving section, the following three methods are considered.

As the first method, there is provided a method for preparing a different container containing an initial developer, temporarily taking out the developing device from the image forming apparatus when the apparatus is started to be used, opening the lid of the receiving section, and inserting the initial developer from the prepared different container into the receiving section.

As the second method, there is provided a method for previously mounting a container containing an initial developer on the receiving section, removing a partition member between the receiving section and the container when the apparatus is started to be used, and dropping and inserting the initial developer from the container into the receiving section.

As the third method, a method for previously inserting the initial developer into the receiving section at the time of shipment of the apparatus is considered.

However, in the first method, the operation for temporarily taking out the developing device from the main body of the apparatus when the apparatus is started to be used, opening the lid of the receiving section, and transferring the initial developer from the container into the receiving section is required and the load of the operation of the operator is heavy.

In the second method, the operation for opening the lid of the receiving section and inserting the initial developer as in the first method is omitted, but it is necessary to provide a space for installing the container containing the initial developer on or above the receiving section and the requirement of space saving cannot be met.

In the third method, there is a possibility that the initial developer previously received in the receiving section will be leaked when the apparatus main body is transferred at the time of shipment of the apparatus.

BRIEF SUMMARY OF THE INVENTION

This invention has been made by taking the above facts into consideration and an object of this invention is to provide a developing device capable of easily and stably setting up an initial developer without the necessity of providing an exclusive space for receiving the initial developer in an image forming apparatus and an image forming apparatus having the above developing device.

In order to attain the above object, a developing device of this invention comprises a receiving section for receiving a developer; an opening portion for permitting the developer to be transferred into the receiving section; an auger for transferring the developer towards the opening portion; a transferring chamber for accommodating the auger; a developing roller for transferring the developer in the receiving section to an electrostatic latent image formed on an image carrier; and a seal member for openably sealing the opening portion while an initial developer used when the device is started to be used is kept received in the transferring chamber.

Further, a developing device of this invention comprises a receiving section for receiving a developer; an opening portion for permitting the developer to be transferred into the receiving section; an auger for transferring the developer towards the opening portion; a transferring chamber for accommodating the auger; supply means for supplying the developer to the transferring chamber; a developing roller for transferring the developer in the receiving section to an electrostatic latent image formed on an image carrier; and a seal member for openably sealing the opening portion while an initial developer used when the device is started to be used is kept received in the transferring chamber.

Further, an image forming apparatus of this invention comprises an image carrier on which an electrostatic latent image is formed; a developing device for supplying a developer to the electrostatic latent image formed on the image carrier to develop the same; paper feeding means for feeding paper towards the developer image developed by the developing device; transferring means for transferring the developer image onto the paper fed by the paper feeding means; and fixing means for fixing the developer image transferred onto the paper by the transferring means on the paper; wherein the developing device includes a receiving section for receiving a developer, an opening portion for permitting the developer to be transferred into the receiving section, an auger for transferring the developer towards the opening portion, a transferring chamber for accommodating the auger, a developing roller for transferring the developer in the receiving section to the electrostatic latent image formed on the image carrier; and a seal member for openably sealing the opening portion while an initial developer used when the device is started to be used is kept received in the transferring chamber.

DETAILED DESCRIPTION OF THE INVENTION

There will now be described embodiments of this invention with reference to the accompanying drawings.

Figure 1:
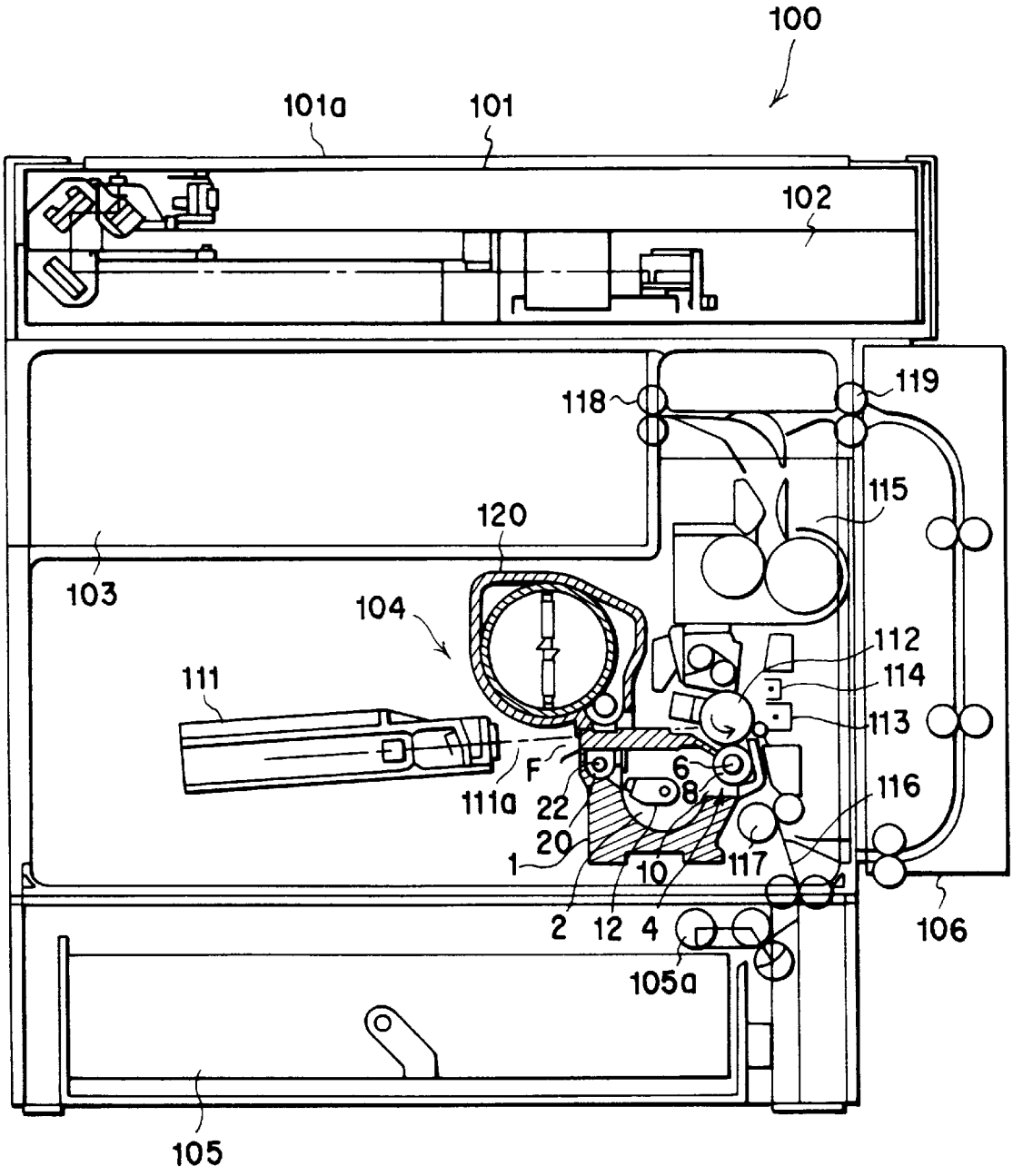
FIG. 1 is a schematic view of an image forming apparatus having a developing device according to this invention mounted thereon as viewed from the front side.

In FIG. 1, the schematic view of a digital copying machine 100 (which is hereinafter simply referred to as a copying machine 100) having a developing device 1 according to an embodiment of this invention mounted thereon as viewed from the front side thereof is shown.

The copying machine 100 has a document table 101 on which a document as a to-be-copied object is placed on the upper surface thereof. A cover 101*a* for holding the document is provided on the document table 101 so as to be set in the open/closed position.

Below the document table 101, a scanner section 102 for applying light to the document set on the document table 101, reading reflected light therefrom as image information and creating an image signal based on the read image information is provided.

Below the scanner section 102, a paper discharging section 103 of in-body paper discharging type for discharging paper having an image formed thereon is provided.

Further below the paper discharging section 103, an image forming section 104 for forming an image based on an image signal created by the scanner section 102 or an image signal input from an external device (not shown) on paper is provided.

Further below the image forming section 104, a paper feeding cassette 105 which accommodates a plurality of sheets of paper is provided so as to be removable from the front side of the main body of the copying machine.

On the right side of the copying machine 100 in the drawing, an inverting unit 106 for inverting paper having an image formed on one surface thereof by use of the image forming section 104 and supplying the paper again to the image forming section 104 is removably mounted on the main body of the apparatus.

The image forming section 104 includes an exposure device 111 for emitting a laser beam according to an image signal supplied from the scanner section 102 or external device, a photosensitive drum 112 for holding an electrostatic latent image based on exposure-scanning of the laser beam emitted from the exposure device 111 on the surface thereof, a developing device 1 for supplying a developer to the electrostatic latent image formed on the surface of the photosensitive drum 112 to visualize the same, a transfer charger 113 for transferring a toner image on the surface of the photosensitive drum 112 which is developed by the developing device 1 onto paper taken out from the paper feeding cassette 105, a separation charger 114 for separating the paper having the toner image transferred thereon from the surface of the photosensitive drum 112, and a fixing device 115 for passing the paper separated from the drum surface by the separation charger 114, heating and melting the toner image transferred on the paper and fixing the melted toner image on the paper.

Figure 2:
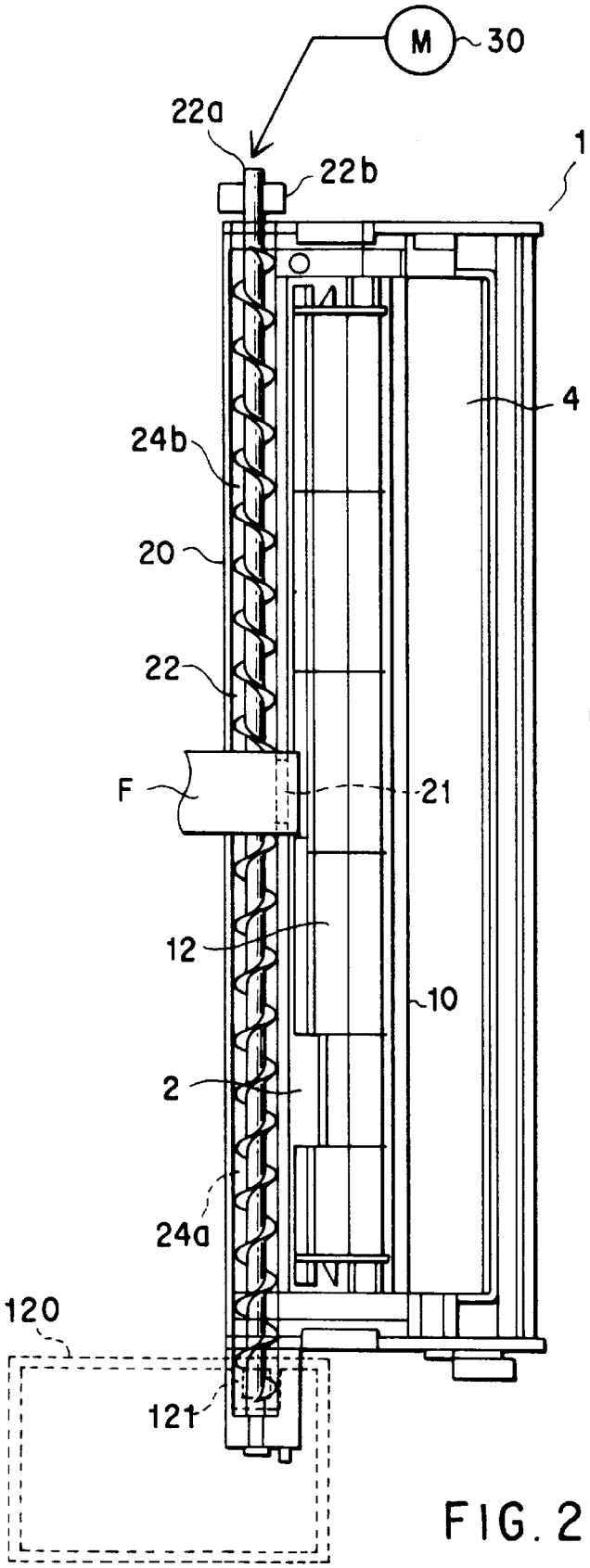
FIG. 2 is a plan view showing the developing device according to the first embodiment of this invention and incorporated into the image forming apparatus of FIG. 1.

Above the developing device 1, a toner cartridge 120 for supplying toner into the developing device 1 is mounted. As shown in FIG. 2, the toner cartridge 120 is provided in a position offset towards the front side of the copying machine 100 above the developing device 1.

That is, since the copying machine 100 of this embodiment is of an in-body paper discharging type having the paper discharging section 103 in the main body of the apparatus, a vertical transferring structure for vertically transferring paper which has passed the developing device 1 towards the fixing device 115 is used for the convenience of the layout. By using the above structure, a laser beam 111*a* emitted from the exposure device 111 is directed to the photosensitive drum 112 via a portion directly above the developing device 1, and therefor, an attempt is made to offset the toner cartridge 120 towards the front side of the apparatus and prevent the toner cartridge 120 from lying on the optical path of the laser beam.

Next, the image forming operation of the copying machine 100 with the above structure is explained.

If an image signal is supplied from the scanner section 102 or external device, a laser beam whose intensity is modulated based on the image signal is emitted from the exposure device 111 to form an electrostatic latent image based on the image signal on the surface of the photosensitive drum 112 which is previously charged to a preset potential.

The electrostatic latent image formed on the surface of the photosensitive drum 112 passes the developing device 1 by rotation of the photosensitive drum 112. At this time, toner contained in the developer is supplied to the electrostatic latent image to visualize the electrostatic latent image and form a toner image on the surface of the photosensitive drum 112.

Sheets of paper accommodated in the paper feeding cassette 105 are taken out for each sheet and fed to a transferring path 116 by a pickup roller 105*a* disposed on the upper portion of one side of the paper feeding cassette 105 and the front end thereof is temporarily aligned by an aligning roller pair 117.

The toner image formed on the surface of the photosensitive drum 112 is further transferred by rotation of the photosensitive drum 112 and passes a transferring area which faces the transfer charger 113. At this time, the aligning roller pair 117 is rotated in accordance with the transferring timing of the toner image and the paper aligned by the aligning roller pair 117 is fed into the transferring area. Then, the toner image is transferred onto the paper which passes the transferring area.

The paper having the toner image transferred thereon is separated from the surface of the photosensitive drum 112 by the separation charger 114 and fed towards the fixing device 115. When the paper having the toner image transferred thereon passes the fixing device 115, the toner image transferred on the paper is heated and melted, the toner image is fixed on the paper and an image based on the image signal is output to the paper. The paper to which the image is output on one surface as described above is discharged to the paper discharging section 103 via a paper discharging roller 118.

At this time, if it is selected to form an image on the opposite surface of the paper, the paper is fed to the inverting unit 106 via a transferring roller pair 119. The paper having the image formed on one surface thereof and transferred to the inverting unit 106 is transferred to the transferring area via the aligning roller pair 117 again and a preset image is formed on the opposite surface of the paper.

Figure 3:
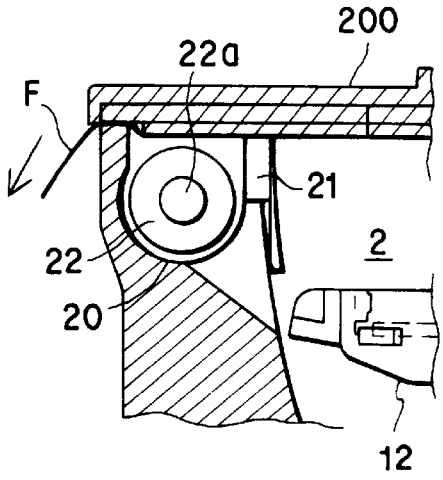
FIG. 3 is a partial cross sectional view showing an enlarged portion of the main part of the developing device of FIG. 2.

Next, the developing device 1 of the first embodiment of this invention is explained in detail with reference to FIGS. 1 to 3. FIG. 1 shows the cross section of the developing device 1 as viewed from the front side, FIG. 2 is a plan view of the developing device 1 with an upper lid 200 thereof removed and FIG. 3 shows an enlarged portion of the structure of the main part of this invention.

The developing device 1 includes a receiving section 2 which receives a developer containing toner and carrier. The receiving section 2 is extended over the width of the paper from the front side of the copying machine 100 to the rear side thereof. When the copying machine 100 is started to be used, an initial developer is inserted into the receiving section 2 and only toner is supplied into the receiving section 2 at the time of supplement of the developer. The initial developer is a mixture of toner and carrier in a proper ratio. As the toner, magnetic toner containing a magnetic material is used and iron powder or the like is used as the carrier.

In a position in which the developing device 1 faces the photosensitive drum 112, that is, in a portion obliquely above the receiving section 2 in the drawing, a developing roller 4 for supplying a developer in the receiving section 2 to the photosensitive drum 112 is disposed. The developing roller 4 includes a magnet roller 6 disposed to extend in parallel to the photosensitive drum 112 and a developing sleeve 8 coaxially and rotatably mounted around the magnet roller 6. The developing sleeve 8 is positioned so that the outer peripheral surface thereof faces the surface of the photosensitive drum 112 with a preset developing gap provided therebetween. On the outer peripheral surface of the developing sleeve 8, a doctor blade for controlling the transferring amount of the developer held on the outer peripheral surface thereof is disposed in opposition thereto.

In the receiving section 2, an agitator 12 for stirring up the developer received in the receiving section 2 into a gap 10 which lies below the developing roller 4 is disposed. The agitator 12 is rotated in a counterclockwise direction in FIG. 1.

The developer in the receiving section 2 is stirred up into the gap 10 which lies below the developing roller 4 by rotation of the agitator 12. The developer stirred up into the gap 10 is adsorbed on the outer peripheral surface of the developing sleeve 8 by magnetic force of the magnet roller 6. The developer adsorbed on the outer peripheral surface of the developing sleeve 8 is transferred by rotation of the developing sleeve 8 and supplied to the developing gap facing the surface of the photosensitive drum 112 while the transferring amount thereof is controlled by the doctor blade.

In an upper left portion of the receiving section 2 in the drawing, a transferring chamber 20 for transferring toner dropped from the toner cartridge 120 towards the receiving section 2 is disposed. Like the receiving section 2, the transferring chamber 20 extends from the front side of the copying machine 100 towards the rear side thereof and is communicated with a toner supply port 121 of the toner cartridge 120 in the end portion thereof on the front side (FIG. 2).

In substantially the central position of the transferring chamber 20 along the longitudinal direction thereof, an opening portion 21 communicated with the receiving section 2 to drop the toner in the transferring section 20 into the receiving section 2 is formed. Further, in the transferring chamber 20, an auger 22 for transferring the toner in the transferring chamber towards the opening portion 21 while stirring the same is rotatably disposed and formed to extend. On a rotating shaft 22*a* of the auger 22, spiral-form blades 24*a*, 24*b* which are formed in the opposite direction to transfer toner from the front side and rear side towards the opening portion 21 are formed. On the end portion of the rotating shaft 22*a* of the auger 22 on the rear side, a gear 22*b* connected to a main motor 30 via a driving force transmission mechanism (not shown) is mounted. The auger 22 can be rotated at a variable rotation speed.

When toner in the toner cartridge 120 is supplied into the receiving section 2, the toner received in the toner cartridge 120 is dropped into the transferring chamber 20 from the end portion of the transferring chamber 20 on the front side, via a toner supply port 121. The toner dropped into the transferring chamber 20 is transferred to the central opening portion 21 while it is stirred in the transferring chamber 20 by rotating the auger 22 in a preset direction. Then, the toner is dropped into the receiving section 2 via the opening portion 21.

As shown in detail in FIG. 3, in a state of the copying machine 100 of this invention before it is started to be used, a film F used as a seal member for tightly closing the opening portion 21 is attached to the opening portion 21 of the transferring chamber 20 which is communicated with the receiving section 2. The end portion of the film F passes below the upper lid 200 of the developing device 1 and extends to the exterior of the developing device 1 so that it can be drawn out by the operator.

The copying machine 100 of this invention is shipped in a state in which initial developer is loaded in the transferring chamber 20 having the opening portion 21 tightly closed by the film F and the upper lid 200 of the developing device 1 is closed. Then, when the copying machine 100 is started to be used, the end portion of the film F which extends to the exterior of the developing device 1 is held and drawn out by the operator to open the opening portion 21 of the transferring chamber 20. In this state, the main motor 30 is rotated to rotate the auger 22 in a preset direction so as to transfer the initial developer loaded in the transferring chamber 20 towards the opening portion 21 while it is being stirred.

The initial developer dropped into the receiving section 2 via the opening portion 21 is stirred up into the gap below the developing roller 4 by rotation of the agitator 12, held on the outer peripheral surface of the developing sleeve 8 and supplied to the developing gap. Thus, setup of the initial developer is completed.

The rotation speed of the auger 22 at the time of setup of the initial developer may be set at the same rotation speed at the normal toner supply time, but the rotation speed of the auger 22 at the setup time can be set higher than the rotation speed at the normal toner supply time. Thus, if the rotation speed of the auger 22 at the setup time is set high, the operation time required for setup of the initial developer can be reduced.

As described above, according to the developing device 1 of this embodiment, initial developer required when the copying machine 100 is started to be used is previously loaded in the transferring chamber 20. Therefore, it is not necessary for the operator to take out the developing device from the main body of the copying machine and insert initial developer into the developing device when the copying machine is started to be used like the conventional case, and initial developer can be set up simply by drawing out the film F which extends out to the exterior of the developing device 1 and rotating the auger 22 and the operation load required for setup of initial developer when the copying machine is started to be used can be markedly reduced.

Further, in this embodiment, since initial developer is received by use of the transferring chamber 20 which is originally provided in the developing device 1, it is not necessary to provide a space exclusively used for disposing a container for receiving initial developer and thus space saving can be attained. Particularly, in a case of the copying machine 100 using the vertical transferring structure which can attain the in-body paper discharging operation as in the present embodiment, if a container for receiving initial developer is mounted on the upper portion of the developing device 1, a laser beam emitted from the exposure device 111 is interrupted by the container. Therefore, it is effective to apply this invention to a copying machine having the vertical transferring structure.

Further, by previously receiving initial developer in the transferring chamber 20 as in this invention, it is not necessary to previously insert initial developer into the developing device at the time of shipment of the copying machine as in the conventional case and there is no possibility that the initial developer is leaked at the time of transfer of the copying machine.

Particularly, in a case where the copying machine is shipped with initial developer previously received in the developing device, since an amount of initial developer previously received in the developing device is smaller than the capacity of the receiving section of the developing device, the initial developer is put together on one side in the receiving section in some cases by vibrations or the like at the time of transfer of the copying machine. If the initial developer is put together on one side in the receiving section, the operation for uniformly distributing the initial developer in the receiving section becomes necessary.

However, in the developing device of this invention, since initial developer is previously loaded in the transferring chamber 20, the above problem does not occur.

Further, in the developing device of this invention, initial developer is loaded in the transferring chamber 20, and therefore, even if the storage period from loading of the initial developer to the shipment of the copying machine becomes long and a sticking phenomenon (caking) occurs in the initial developer in the transferring chamber 20, even the stuck initial developer can be easily and stably transferred into the receiving section 2 since the initial developer is transferred after it is stirred in the transferring chamber 20 by rotating the auger 22 at the time of setup of the initial developer.

Figure 4:
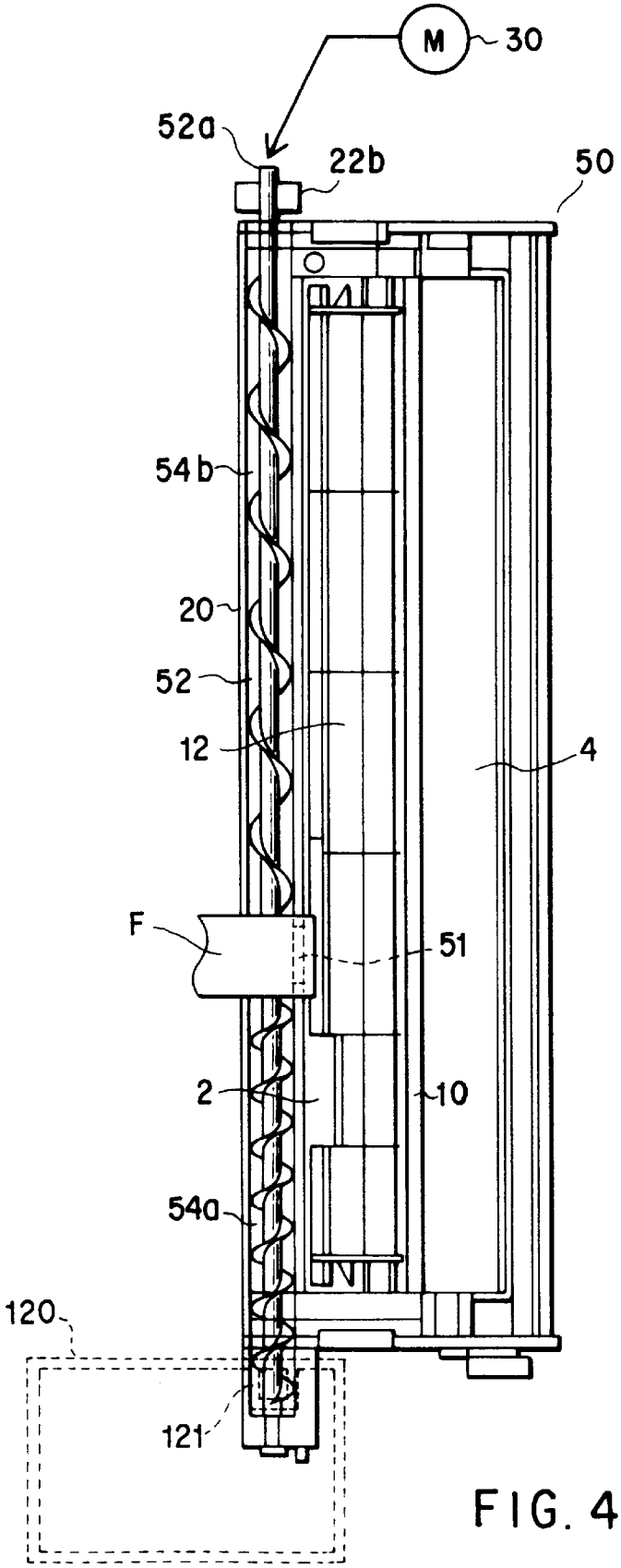
FIG. 4 is a plan view showing a developing device according to a second embodiment of this invention.

Next, a developing device 50 according to a second embodiment of this invention is explained with reference to FIG. 4. Constituents which function in the same manner as those of the developing device 1 in the first embodiment are denoted by the same reference numerals and the detail explanation therefor is omitted.

The developing device 50 includes a transferring chamber 20 which transfers toner dropped from a toner cartridge 120 while stirring the same and an opening portion 51 is formed between the transferring chamber and a receiving section 2 to communicate the transferring chamber with the receiving section 2. The opening portion 51 is formed in a position offset from the center of the transferring chamber 20 towards the front side or rear side of the device. In this embodiment, the opening portion 51 is formed in a position offset from the center of the transferring chamber 20 in the longitudinal direction thereof towards the front side of the device.

Spiral-form blades 54*a*, 54*b* which respectively extend in opposite directions from the front side and rear side of the device towards the opening portion 51 at different pitches are formed on an rotating shaft 52*a* of an auger 52 disposed in the transferring chamber 20. That is, the spiral-form blade 54*a* which is relatively short and is disposed on the front side of the device is formed with approximately the same pitch as that of the blades 24*a*, 24*b* in the above-described first embodiment and the spiral-form blade 54*b* which is relatively long and is disposed on the rear side is formed with a pitch longer than that of the blade 54*a* disposed on the front side.

In a case where the opening portion 51 is formed in a position offset from the center of the transferring chamber 20 in the longitudinal direction thereof like the present embodiment and when the initial developer loaded in the transferring chamber 20 is set up, the pitches of the spiral-form blades 54*a*, 54*b* of the auger 52 are required to be so changed that initial developer transferred from the farthest position on the front side of the device to the opening portion 51 and initial developer transferred from the farthest position on the rear side of the device to the opening portion 51 will reach the opening portion 51 at substantially the same time.

Thus, a difference in the transferring speed of the initial developer transferred from the front side and rear side of the transferring chamber 20 will not occur and it becomes possible to rapidly drop the entire initial developer loaded in the transferring chamber 20 into the receiving section 2 via the opening portion 51.

This invention is not limited to the above embodiments and can be variously modified without departing from the technical scope thereof.

What is claimed is:

1. A developing device comprising:

a receiving section for receiving a developer;

an opening portion for permitting the developer to be transferred into said receiving section;

an auger for transferring the developer towards said opening portion;

a transferring chamber for accommodating said auger;

a developing roller for transferring the developer in said receiving section to an electrostatic latent image formed on an image carrier; and a seal member for openably sealing said opening portion while an initial developer used when the device is started to be used is kept received in said transferring chamber.

2. The developing device according to claim 1, wherein said seal member is attached to be drawn from the exterior of the developing device.

3. The developing device according to claim 1, wherein said auger transfers the initial developer in said transferring chamber towards said opening portion while stirring the same.

4. A developing device comprising:

a receiving section for receiving a developer;

an opening portion for permitting the developer to be transferred into said receiving section;

an auger for transferring the developer towards said opening portion;

a transferring chamber for accommodating said auger;

supply means for supplying the developer to said transferring chamber;

a developing roller for transferring the developer in said receiving section to an electrostatic latent image formed on an image carrier; and a seal member for openably sealing said opening portion while an initial developer used when the device is started to be used is kept received in said transferring chamber.

5. The developing device according to claim 4, wherein said seal member is attached to be drawn from the exterior of the developing device.

6. The developing device according to claim 4, wherein said auger transfers the initial developer in said transferring chamber towards said opening portion while stirring the same.

7. The developing device according to claim 4, further comprising driving means for rotating said auger at a first speed when the developer supplied into said transferring chamber from said supply means is transferred into said receiving section via said opening portion and rotating said auger at a second speed higher than said first speed when the initial developer in said transferring chamber is transferred into said receiving section via said opening portion.

8. The developing device according to claim 4, wherein said auger has a rotating shaft extending in a preset direction, a first blade of spiral form formed from one end portion of said rotating shaft towards said opening portion and a second blade of spiral form formed in a direction opposite to that of said first blade from the other end portion of said rotating shaft towards said opening portion and rotates said rotating shaft in the preset direction to transfer the initial developer in said transferring chamber towards said opening portion.

9. The developing device according to claim 8, wherein said opening portion is formed in a position offset from the center of said rotating shaft to the one end portion and said second blade is formed with a longer pitch than said first blade.

10. An image forming apparatus comprising:

an image carrier on which an electrostatic latent image is formed;

a developing device for supplying a developer to the electrostatic latent image formed on said image carrier to develop the same;

paper feeding means for feeding paper towards a developer image developed by said developing device;

transferring means for transferring the developer image onto the paper fed by said paper feeding means; and fixing means for fixing the developer image transferred onto the paper by said transferring means on the paper;

wherein said developing device includes a receiving section for receiving a developer, an opening portion for permitting the developer to be transferred into the receiving section, an auger for transferring the developer towards the opening portion, a transferring chamber for accommodating said auger, a developing roller for transferring the developer in the receiving section to the electrostatic latent image formed on the image carrier; and a seal member for openably sealing the opening portion while an initial developer used when the device is started to be used is kept received in the transferring chamber.

11. The image forming apparatus according to claim 10, wherein said seal member is attached to be drawn from the exterior of the developing device.

12. The image forming apparatus according to claim 10, wherein said auger transfers the initial developer in said transferring chamber towards said opening portion while stirring the same.

* * * * *